US006378859B1

(12) United States Patent
Lübben et al.

(10) Patent No.: US 6,378,859 B1
(45) Date of Patent: Apr. 30, 2002

(54) METHOD FOR CONTROLLING A DEVICE USED TO REMOVE PACKAGES FROM A PILE

(75) Inventors: Hauke Lübben, Radolfzell; Eckehardt Grimm, Constance; Frank Gerstenberg, Berlin, all of (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 09/600,427

(22) PCT Filed: Jan. 8, 1999

(86) PCT No.: PCT/DE99/00025

§ 371 Date: Jul. 17, 2000

§ 102(e) Date: Jul. 17, 2000

(87) PCT Pub. No.: WO99/36195

PCT Pub. Date: Jul. 22, 1999

(51) Int. Cl.[7] ..... B65H 5/00

(52) U.S. Cl. ..... 271/10.03; 271/10.07; 271/34; 271/370; 271/265.02

(58) Field of Search ..... 271/10.02, 10.03, 271/10.05, 10.07, 34, 270, 275, 265.02, 202; 414/797.2, 797.6

(56) References Cited

U.S. PATENT DOCUMENTS

| | | | | |
|---|---|---|---|---|
| 3,108,801 A | * | 10/1963 | Van Dalen | 271/34 |
| 3,981,493 A | * | 9/1976 | Klappenecker et al. | 271/34 |
| 4,077,620 A | * | 3/1978 | Frank et al. | 271/10.03 |
| 4,171,130 A | * | 10/1979 | Jeschke et al. | 271/10.03 |
| 4,541,624 A | | 9/1985 | Sasage et al. | |
| 4,691,912 A | * | 9/1987 | Gillmann | 271/34 |
| 5,423,527 A | * | 6/1995 | Tranquilla | 271/270 |
| 5,664,771 A | * | 9/1997 | Nagatani et al. | 271/10.03 |
| 5,941,518 A | * | 8/1999 | Sokac et al. | 271/10.05 |
| 6,076,821 A | * | 6/2000 | Embry et al. | 271/10.03 |

FOREIGN PATENT DOCUMENTS

| | | | | |
|---|---|---|---|---|
| DE | 34 24 397 | | 1/1986 | |
| DE | 196 07 304 | | 7/1997 | |
| EP | 0 057 810 | | 8/1982 | |
| EP | 0 227 998 | | 7/1987 | |
| EP | 0 167 091 | | 1/1996 | |
| JP | 402188344 A | * | 7/1990 | 271/265.02 |
| WO | 092016444 A1 | * | 10/1992 | 271/265.02 |

* cited by examiner

*Primary Examiner*—H. Grant Skaggs
(74) *Attorney, Agent, or Firm*—Venable; Robert Kinberg

(57) ABSTRACT

The invention relates to a method for controlling an apparatus for doffing flat shipments at a controllable doffing speed that delivers the shipments at constant speed to driven conveyor belts. According to the invention, the speed at which the shipment to be doffed must be transported, from the time it reaches a first sensor for detecting the shipments until it reaches a corresponding second sensor in order to achieve a desired gap is ascertained. The first sensor is located at the position at which the shipments (1') to be doffed have reached a fixed mean doffing speed, and the second sensor is located at the point of takeover by the conveyor belts.

8 Claims, 1 Drawing Sheet

METHOD FOR CONTROLLING A DEVICE USED TO REMOVE PACKAGES FROM A PILE

BACKGROUND OF THE INVENTION

The invention relates to a method and an apparatus for controlling pick-off (doffing) and to a method of controlling the speed of flat item doffing apparatus such that a desired gap is maintained between doffed and to-be doffed items.

Doffing the frontmost shipments in each case from a stack of shipments must be done while maintaining a predetermined minimum gap. This minimum gap should not be undershot, so that downstream parts of the system are capable of handling the individual shipments. At the same time, the mean gap attained should exceed the minimum gap as little as possible, so that a high shipment throughput can be attained.

From European Patent Disclosure EP 0 167 091 A1, corresponding to German Patent Disclosure DE 34 24 397 A1, and German Patent DE 196 07 304 C1, apparatuses for doffing flat shipments from a stack are known. These apparatuses have a controlled doffing device, which doffs the frontmost shipment from a stack in each case and advances it to the grasping region of a pair of driven feed rollers; between the outlet of the stack and the feed rollers, there is a measuring segment in the form of a line of light gates, whose output signals are delivered to a control circuit. In EP 0 167 091 A1, the drive of the doffing device for doffing a shipment is effected such that the spacing between the shipment to be doffed and an already doffed shipment is ascertained, and the result of the spacing measurement in each case is corrected by a predetermined value dependent on the acceleration of the item to be doffed, and the doffing is triggered when the magnitude of the thus-corrected spacing measurement corresponds to a desired spacing value.

The use of the predetermined value makes it possible to take different mechanical properties of various shipments and their effect into account in the acceleration process.

A variable behavior of the shipments in the doffing operation also results from the variable position of the shipments in the stack from which the shipments are doffed. Once again, this leads to different gaps and hence to sacrifices in throughput.

For more-precise gap control, the shipment to be doffed is therefore, according to German Patent DE 196 07 304 C1, initially accelerated to an intermediate speed value, which is less a predetermined final speed. As soon as the actual spacing is equal to the desired spacing, the shipment is accelerated to the final speed.

These known embodiments require a complicated measuring segment in the form of a line of light gates, with which both the position of the doffed shipments (rear edge, as long as it is located inside the measuring segment) and the position of the next shipment to be doffed (front edge) are detected on an ongoing basis, in order to ascertain the correct times for accelerating the shipment to be doffed.

Furthermore, U.S. Pat. No. 4,541,624 describes a doffing apparatus in which the shipments, standing on the lower edge, are doffed upward; that is, the different lengths of shipments must be taken into account. Doffing and correction means are driven constantly, but at different fixed speeds, the respective duration of which is ascertained. No measure of the actual spacing of the shipment to be doffed from the doffed shipment is made. This spacing is not calculated until the shipment to be doffed has already been doffed; that is, defined shipment spacing cannot be assured.

SUMMARY OF THE INVENTION

The invention provides a method and an apparatus for picking off (doffing) flat shipments from a stack that, without a measuring segment of lined-up sensors for detecting the shipments, control the doffing in such a way that a minimum gap between the shipments that is optimal for further handling of the shipments is maintained.

There is no longer a need to measure the spacing between the doffed shipment from the shipment to be doffed on an ongoing basis in order to determine the time for accelerating the shipment to be doffed. Instead, the speed at which the shipment to be doffed, once it reaches the first sensor, must be transported to the second sensor in order to achieve the desired gap is ascertained; that is, a line of sensors is no longer necessary.

BRIEF DESCRIPTION OF THE DRAWINGS

The invention is described in further detail below in conjunction with the drawings. Shown are FIG. 1, an apparatus according to the invention.

DETAILED DESCRIPTION OF THE INVENTION

Figure 1:
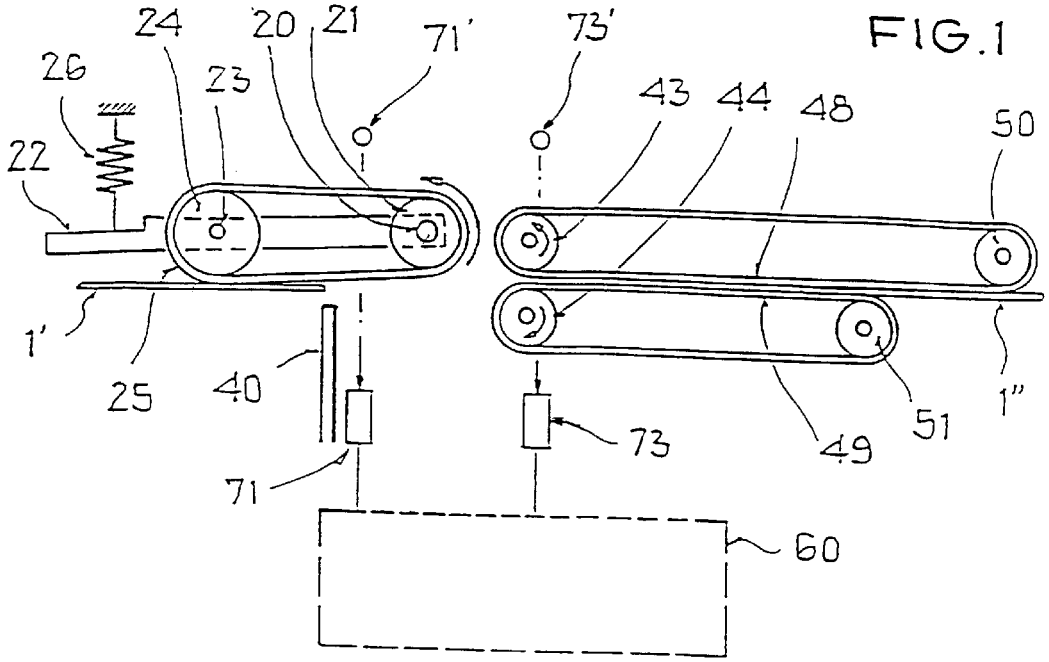

FIG. 1 shows a preferred exemplary embodiment of an apparatus according to the invention. A shaft 20 is provided, solidly supported but freely rotatable, and a roller 21 is secured to it. The shaft 20 also serves the purpose of pivotable support of a rocker 22, which carries the shaft 23 of a further roller 24. As a separating device, at least one doffing belt 25, whose outer surface has a high coefficient of friction, is extended around the roller 21 and the doffing roller 24.

The rocker 22 is braced against a schematically indicated spring 26, so that its position at a given time depends on the contact pressure of the stack of shipments, of which the frontmost shipment 1' is shown as it is being doffed. The free end of the rocker 22 acts on a microswitch, not shown. If the contact pressure of the stack is too low, then a resting contact of the microswitch closes, thus turning on a geared motor, not shown. The geared motor, at the end of the stack, drives a supporting wall in the direction of the doffing roller 24 until such time as the aforementioned resting contact switches off again, after the position of the rocker corresponding to the intended contact pressure has been reached.

The shaft 20 is driven controllably in the direction of the arrow preferably by a servomotor, not shown. The edges pointing in the conveying direction, that is, the front edges of the shipments located in the stack, are located more or less tightly against a stop wall 40, which leaves a gap free from the doffing belt 25 to allow the shipments to pass through, leaving the stack outlet free.

In the conveying path of the shipments, a pair of permanently driven feed rollers 43 and 44 is provided, by which the shipments are necessarily conveyed onward as soon as they have reached the engagement region of these rollers. These feed rollers act here as deflection rollers for conveyor belts 48 and 49, which are guided in the conveying direction on further deflection rollers 50 and 51. While the driven feed roller 43 is solidly supported, the feed roller 44 is supported resiliently in a known manner, for instance on a pivotable lever, but this is not shown in the drawing for the sake of simplicity.

Along the conveying path of the shipments, adjoining a stop wall 40, there is a first light gate 71/71' (FIG. 2), as a sensor for detecting shipments; its light receiver is designated by reference numeral 71, and its associated light source is designated as 71'. Photodiodes or phototransistors are used as the light receiver. This light gate 71/71' is located far enough behind the stop wall 40 that the shipments by that point have attained a mean doffing speed. This mean doffing speed is defined with the aid of statistical data such that the necessary speed changes for performing incident changes in gaps are minimized.

In addition, a second light gate 73/73' with a light source 73' is provided that monitors the engagement region of the feed rollers 43 and 44.

The spacing of the light gates is selected to be great enough that at a fixed maximum speed change, the greatest required changes in gaps can be achieved.

These light gate signals are evaluated by the microprocessor of a control circuit 60. From the bright/dark signals of the light gates, the various positions of the shipments 1' and 1" are ascertained.

Figure 2:
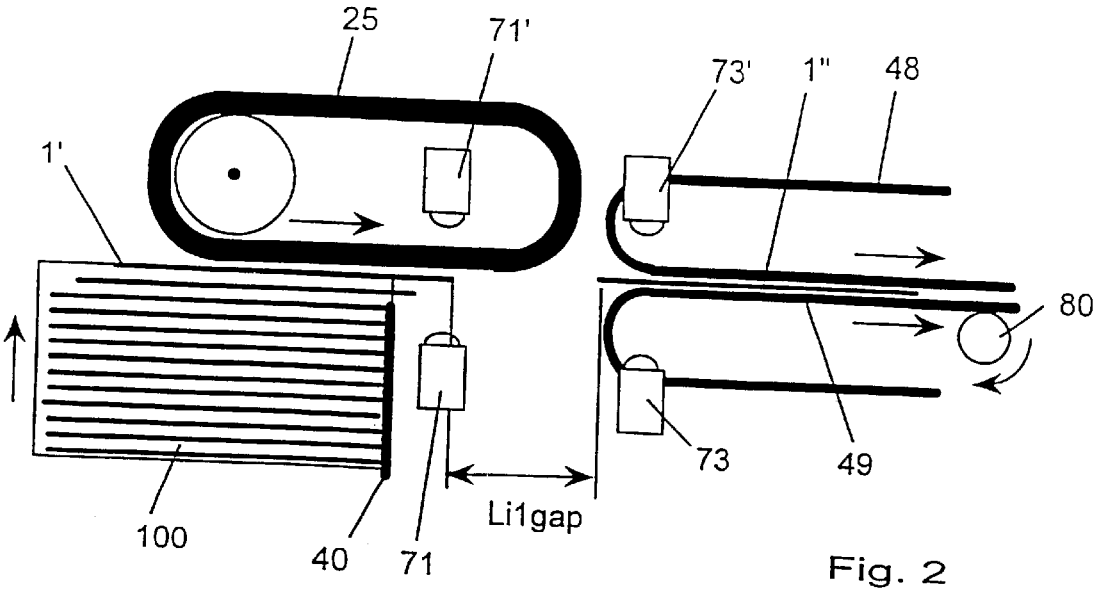
FIG. 2, a simplified illustration of an apparatus according to the invention, showing the stack from which the shipments are to be doffed.

FIG. 2 shows a simplified illustration in which a number of shipments are disposed in a stack 100.

As soon as the control circuit 60 receives the doffing command, the doffing motor is turned on, and the first shipment is started. Once its front edge reaches the second light gate 73/73', the doffing motor is immediately stopped, but the shipment continues to be doffed by the conveyor belts 48 and 49. The doffing motor is not turned again until the following condition is met: the first light gate 71/71' becomes bright.

The doffing motor is now re-started, in order to accelerate the next shipment. As soon as the front edge of this shipment reaches the first light gate 71/71', its position is known. The speed v, is ascertained, at which the shipment must be transported onward until it reaches the second light gate 73/73', so that when it reaches it, it will have the precise spacing of the desired gap from the previously doffed shipment. Accordingly there are no intervening stoppages of the shipment.

The relationships necessary to ascertain the required speed v, at which the next shipment, from the time it reaches the first light gate 71/71' until it reaches the second light gate 73/73', must be transported by the doffing belt 25, in order to achieve the desired gap, are accordingly as follows:

1. Without taking acceleration times and reaction times of the control circuit 60 into account:

$$v\mathbf{1}=(\text{lidist}\cdot V)/(\text{sollue}+\text{lidist}-\text{li}\mathbf{1}\text{gap})$$

2. Taking reaction times T of the control circuit 60 into account:

$$v\mathbf{2}=(\text{lidist}-T\cdot V)\cdot V)/(\text{sollue}+(\text{lidist}-T\cdot V)-\text{li}\mathbf{1}\text{gap})$$

During the acceleration time BZ of the doffing motor, too much (in the event of negative acceleration) or too little (in the event of positive acceleration) of the following travel distance is traversed:

$$((Va-v\mathbf{2})\cdot BZ/2)$$

The result, taking into account acceleration times BZ of the doffing motor and reaction times T of the control circuit 60, is thus:

$$v=((\text{lidist}-T\cdot V)\cdot V)/(\text{sollue}+((Va-v\mathbf{2})\cdot BZ/2)+(\text{lidist}-T\cdot V)-\text{li}\mathbf{1}\text{gap})$$

With the following parameters:

| parameter | unit | meaning |
|---|---|---|
| lidist | m | spacing of the two light gates 71/71' and 73/73' from one another |
| li1gap | m | spacing of the rear edge of the doffed shipment from the first light gate 71/71', when the front edge of the shipment to be doffed reaches the first light gate |
| sollue | m | desired gap between the doffed shipments |
| V | m/s | speed of the conveyor belts equals speed of the doffed shipment, as soon as this shipment has reached the second light gate 73/73' |
| Va | m/s | speed at which the shipment to be doffed is accelerated beyond the first light gate |
| T | s | reaction time of the controller to edge detection at the light gates |
| BZ | s | acceleration/braking time of the doffing motor |

The spacing Li1gap of the rear edge of the doffed shipment from the first light gate 71/71' at the time when the front edge of the shipment to be doffed reaches the first light gate 71/71' is ascertained with the aid of the edge signals of the first light gate 71/71' and with the aid of a clock generator 80. When the front edge of the doffed shipment reaches the second light gate 73/73', this shipment is transported onward at the speed V. Once the rear edge reaches the first light gate 71/71', its position is known, and the spacing Li1gap is obtained by counting the pulses of the clock generator 80 until the time of the front edge signal of the next shipment at the first light gate 71/71'.

What is claimed is:

1. A method for controlling a doffing apparatus for doffing flat items with a controllable doffing speed, and advancing the doffed items to conveyor belts driven at a constant speed V, so that a desired gap is maintained between doffed items, comprising:

(a) positioning a first sensor at a location where to-be-doffed items reach a predetermined average doffing speed and positioning a second sensor at a location of take-over of the items by the conveyor belts;

(b) advancing the flat items toward the conveyor belts;

(c) ascertaining the required speed between the first and second sensors of a to-be-doffed item so that the desired gap exists between the trailing edge of a preceding doffed item and the leading edge of the to-be doffed item at the moment when the leading edge of the to-be-doffed item reaches the second sensor, the required speed being calculated based on the distance between the trailing edge of the preceding doffed item and the first sensor at a time when the to-be doffed item has just reached the first sensor and has thus attained the predetermined average doffing speed; and (d) controlling the speed of the to-be doffed item between the first and second sensors in accordance with the required speed calculated in said ascertaining step.

2. The method of claim 1, further comprising determining the distance between the trailing edge of the preceding doffed item engaged by the conveyor belts and the first sensor at the instant when the leading edge of the to-be-doffed item reaches the first sensor as a function the constant speed V of the conveyer belts and of the time differential between when the first sensor detects the trailing edge of the preceding doffed-item and the leading edge of the to-be doffed item.

3. The method of claim 2, wherein the step of determining includes measuring the time differential with the aid of a clock generator connected to driven feed rollers of the conveyer belts.

4. The method of claim 1, including spacing the first and second sensors sufficiently far apart so that the greatest required gap change is achieved for a fixed maximum doffing speed.

5. The method of claims 1, wherein the ascertaining and controlling steps are performed with the aid of a control circuit having a reaction time, and the method further includes varying the doffing speed beyond the first sensor to compensate for the reaction time of the control circuit.

6. The method of claim 1, including raising or lowering the doffing apparatus to compensate for the acceleration time of changing doffing speeds.

7. An apparatus for doffing flat items comprising:

conveyor belts driven at a constant speed V, a doffing device for delivering the flat items from a stack to the conveyor belts, a first sensor located where to-be-doffed items reach a predetermined average doffing speed;

a second sensor located at a point of take-over of the items by the conveyor belts; and a control circuit which controls doffing times and speeds as a function of the spacing between successive doffed items, the control circuit ascertaining the required speed between the first and second sensors of a to-be doffed item so that the desired gap exists between the trailing edge of a preceding doffed item and the front edge of the to-be doffed item at the moment when the leading edge of the to-be-doffed item reaches the second sensor, the control circuit calculating the required speed based on the distance between the trailing edge of the preceding doffed item and the first sensor at a time when the to-be doffed item has just reached the first sensor and has thus attained the predetermined average doffing speed.

8. The apparatus of claim 7 further, wherein the conveyor belts have driven feed rollers, and further comprising a clock generator connected to the driven feed rollers of the conveyer belts, the clock generator determining the time differential between when the trailing edge of a preceded doffed item is detected by the first sensor and when the leading edge of a to-be-doffed item is detected by the first sensor.

* * * * *

UNITED STATES PATENT AND TRADEMARK OFFICE

CERTIFICATE OF CORRECTION

PATENT NO. : 6,378,859 B1 
DATED : April 30, 2002
INVENTOR(S) : Hauke Lübben, Eckehardt Grimm and Frank Gerstenberg It is certified that error appears in the above-identified patent and that said Letters Patent is hereby corrected as shown below:

Title page,
Insert -- Item [30] Foreign Application Priority Data
January 15, 1998 (DE).....198 01 309.4 --

Signed and Sealed this

Twenty-ninth Day of October, 2002

*Attest:*

*Attesting Officer*

JAMES E. ROGAN
*Director of the United States Patent and Trademark Office*